US006011466A

United States Patent [19]

Goldman

[11] Patent Number: 6,011,466

[45] Date of Patent: Jan. 4, 2000

[54] SEALED GOLF BALL WITH REMOTELY ACTIVATED AUDIBLE SOUND GENERATOR POWERED BY AN ELECTROMAGNETICALLY RECHARGEABLE BATTERY

[76] Inventor: Cheryl Goldman, 1 Mark Ct., Huntington, N.Y. 11743

[21] Appl. No.: 09/160,277

[22] Filed: Sep. 24, 1998

[51] Int. Cl.[7] ..... G08B 1/08

[52] U.S. Cl. ..... 340/539; 340/384.7; 340/571; 340/825.36; 473/353

[58] Field of Search ..... 340/384.1, 384.7, 340/539, 571, 572.1, 825.36, 825.49; 473/353

[56] References Cited

U.S. PATENT DOCUMENTS

| | | | |
|---|---|---|---|
| 3,782,730 | 1/1974 | horchler | 340/323 B |
| 5,423,549 | 6/1995 | Englmeier | 473/353 |
| 5,447,314 | 9/1995 | Yamazaki et al. | 473/353 |
| 5,626,531 | 5/1997 | Little | 473/353 |
| 5,910,057 | 6/1999 | Quimby et al. | 473/353 |

*Primary Examiner*—Daniel J. Wu

[57] ABSTRACT

A sealed golf ball that includes a golf ball, a shock absorber, a coil-shaped miniature receiver antenna in the golf ball receives a first signal, a miniature wireless receiver in the golf ball receives the first signal and generates a second signal in response thereto, an audible acoustic generator in the golf ball receives the second signal and generates a series of audible beeps in response thereto, through the golf ball, and out into the ambient for hearing by a person seeking the golf ball, a rechargeable micro-battery in the golf ball powers the miniature wireless receiver and the audible acoustic generator, a wireless transmitter is carried by the person seeking to locate the golf ball, and selectively generates the first signal, a transmitter antenna transmits the first signal, and a switch when activated, causes the wireless transmitter to generate the first signal and the transmitter antenna to transmit the first signal, which is received by the coil-shaped miniature receiver antenna, which sends the first signal to the miniature wireless receiver, which sends the second signal to the audible acoustic generator, which generates the series of audible beeps, which provides an audible trail to the golf ball to be located.

22 Claims, 22 Drawing Sheets

SEALED GOLF BALL WITH REMOTELY ACTIVATED AUDIBLE SOUND GENERATOR POWERED BY AN ELECTROMAGNETICALLY RECHARGEABLE BATTERY

BACKGROUND OF THE INVENTION

1. Field of the Invention

The present invention relates to a sealed golf ball. More particularly, the present invention relates to a sealed golf ball with remotely activated audible sound generator powered by an electromagnetically rechargeable battery.

2. Description of the Prior Art

Many times when a golf ball is hit over a considerable distance by a golf club during the course of a game of golf, it lands in bushes, high grass, or behind a tree, and can be difficult to find. If the ball cannot be located, the golfer is penalized by two strokes and continues the game with another ball.

Numerous innovations for golf ball and object locators have been provided in the prior art that will be described. Even though these innovations may be suitable for the specific individual purposes to which they address, however, they differ from the present invention in that they do not teach a sealed golf ball with remotely activated audible sound generator powered by an electromagnetically rechargeable battery.

FOR EXAMPLE, U.S. Pat. No. 391,508 to Lucas teaches the ornamental design for a combined transmitter and receiver for locating lost keys.

ANOTHER EXAMPLE, U.S. Pat. No. 3,782,730 to Horchler teaches an electronic golf ball comprising a central resilient sphere, a mass of elastic material surrounding the sphere and an outer casing, the central sphere including an electric squegging oscillator circuit, a battery therefor and a transmitting coil, all enclosed in a spherical mass of a set resin which forms a solid core, the spherical mass being located with close fit in a hollow spherical cavity formed in the central resilient sphere. The battery is a mercury cell located within the transmitting coil, as are the other components of the squegging oscillator circuit. The electrical circuit may include components which permit the oscillator to be turned on and off when the golf ball is brought into, and then moved out of, an A.C. magnetic field having a predetermined frequency.

STILL ANOTHER EXAMPLE, U.S. Pat. No. 4,101,873 to Anderson et al. teaches miniaturized coded transmitter and battery powered receivers that are electively responsive to a predetermined code transmission and are provided with a miniaturized audible signal generator in each receiver such that the receiver, when interrogated by a proper signal, will respond audibly. By placing such receivers on commonly used objects such as eyeglasses, purses, and other personal articles, audible location of these articles is accomplished by interrogating each object with a corresponding coded signal and following the audible response from the object to the position of the object to locate the latter. The duty cycle of the receiver is very short and recurrent over intervals less than the known energization interval of the transmitter to insure reception, but materially minimize the power consumption of the receivers.

YET ANOTHER EXAMPLE, U.S. Pat. No. 4,507,653 to Bayer teaches a miniature, battery-operated electronic unit adapted to be attached to a common article, such as keys or eyeglasses. The unit is responsive to a plurality of sounds for emitting audible tones to enable a misplaced article to be located. A sound detecting and indicating circuit provides the audible tones upon receipt of a sequence of sounds falling within predetermined frequency, time spacing, and amplitude ranges. The correct sequence of sounds is generated by the user by clapping, whistling, or making any other loud sounds, and no additional transmitting device is required. Improper sequences of sounds are prevented from producing false activation of the unit. Extremely low power consumption, resulting in part from CMOS technology, allows the unit to remain on continuously for a period of six to nine months using standard camera (button cell) batteries. Special battery-saver circuitry prolongs battery life. The unit can be fabricated using gate array or custom chip technology, which results in extremely small size and low cost of manufacture. A visual indicator allows the user to learn proper operation.

STILL YET EXAMPLE, U.S. Pat. No. 5,423,549 to Englmeier teaches a device with a signal receiving unit for locating golf balls. Each golf ball is associated with a transmitting unit and the signals emitted by each transmitting unit are detected by the signal receiving unit. The transmitting unit is associated with an energy store as an operating voltage source. The device includes a charging circuit with an energy transmitter for wireless transmission of the electrical energy to an energy receiver connected in front of the energy store. Immediately after the charging phase of the energy store, the transmitting unit starts sending transmission signals and in so doing discharges the energy store. The transmitted signals received by the signal receiving unit are fed to an evaluation circuit which produces an output signal for locating the golf ball. This output signal is then fed to a display unit. After a certain discharge time, the transmitting unit stops transmitting the transmission signals. The golf ball is located only during this limited transmission time. Golf balls which have been mishit can be located rapidly and simply using the device.

YET STILL EXAMPLE, U.S. Pat. No. 5,447,314 to Yamazaki et al. teaches a sound emitting golf ball for locating a golf ball after it is struck by a golf club. The system comprises a miniaturized electronic, battery powered piezoelectric sound generator surrounded by a shock absorber that is embedded inside a golf ball. The sound generating system is constructed with very small, inexpensive shock resistant components and embedded at the center of the golf ball, inside the shock absorber. The system can be designed to operate in the audible or ultrasonic range.

STILL YET EXAMPLE, U.S. Pat. No. 5,626,531 to Little teaches golf balls that have a passive tag at selected capacitance inserted within their interior to enable detection of the presence of the tag, and of the ball, using an electronic detecting system. The tags are passive, being energized into emitting a signal by the presence of a detector field of predetermined characteristics such that the tag generates a responsive signal, which can be detected by an adjacent detector circuit, to signal the presence of a tagged ball. One field of use is for driving ranges, where the unauthorized removal of range balls constitutes an unacceptable loss for the proprietors of the establishment. The system also lends itself to finding lost balls, using a hand-portable detector, and to use with other types of game ball.

FINALLY, YET STILL EXAMPLE, U.S. Pat. No. 5,686,891 to Sacca et al. teaches a system for locating an object. The system includes an electronic device, a wireless transmitter for outputting a transmitted signal, and a receiver wherein one of the receiver and the transmitter is mounted within the electronic device and the other is positioned remote therefrom. The receiver comprises a wake up timer circuit for periodically generating a wake up signal, a wireless signal receiver being activated by the receipt of the wake up signal from the wake up timer circuit for generating a detect signal when the wireless signal receiver circuit receives the transmitted signal from the transmitter, and an audible signal generator circuit for generating an audible signal upon receipt of the detect signal from the wireless signal receiver circuit. The wake up timer circuit and the wireless signal receiver circuit are disabled when the audible signal generator circuit generates the audible signal.

It is apparent that numerous innovations for golf ball and object locators have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a sealed golf ball with remotely activated audible sound generator powered by an electromagnetically rechargeable battery that avoids the disadvantages of the prior art.

ANOTHER OBJECT of the present invention is to provide a sealed golf ball with remotely activated audible sound generator powered by an electromagnetically rechargeable battery that is simple and inexpensive to manufacture.

STILL ANOTHER OBJECT of the present invention is to provide a sealed golf ball with remotely activated audible sound generator powered by an electromagnetically rechargeable battery that is simple to use.

BRIEFLY STATED, YET ANOTHER OBJECT of the present invention is to provide a sealed golf ball that includes a golf ball, a shock absorber contained in the golf ball, a coil-shaped miniature receiver antenna contained in the golf ball, and receives a first signal, a miniature wireless receiver contained in the golf ball, is in electrical communication with, and receives the first signal from, the coil-shaped miniature receiver antenna, and generates a second signal in response thereto, an audible acoustic generator is contained in the golf ball, is in electrical communication with the miniature wireless receiver, receives the second signal from the miniature wireless receiver, and generates a series of audible beeps through the golf ball, and out into the ambient for hearing by a person seeking the golf ball, a rechargeable micro-battery contained in the golf ball, and is in electrical communication with, and powers, the miniature wireless receiver and the audible acoustic generator, a transmitter housing carried by the person seeking to locate the golf ball, a wireless transmitter contained in the transmitter housing, and selectively generates the first signal, a transmitter antenna disposed on the transmitter housing, is in electrical communication with the wireless transmitter, and transmits the first signal, a switch disposed on the transmitter housing, and is in electrical communication with the wireless transmitter, and when activated, causes the wireless transmitter to generate the first signal and the transmitter antenna to transmit the first signal, which is received by the coil-shaped miniature receiver antenna, which sends the first signal to the miniature wireless receiver, which sends the second signal to the audible acoustic generator, which generates the series of audible beeps, which provides an audible trail to the golf ball to be located.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
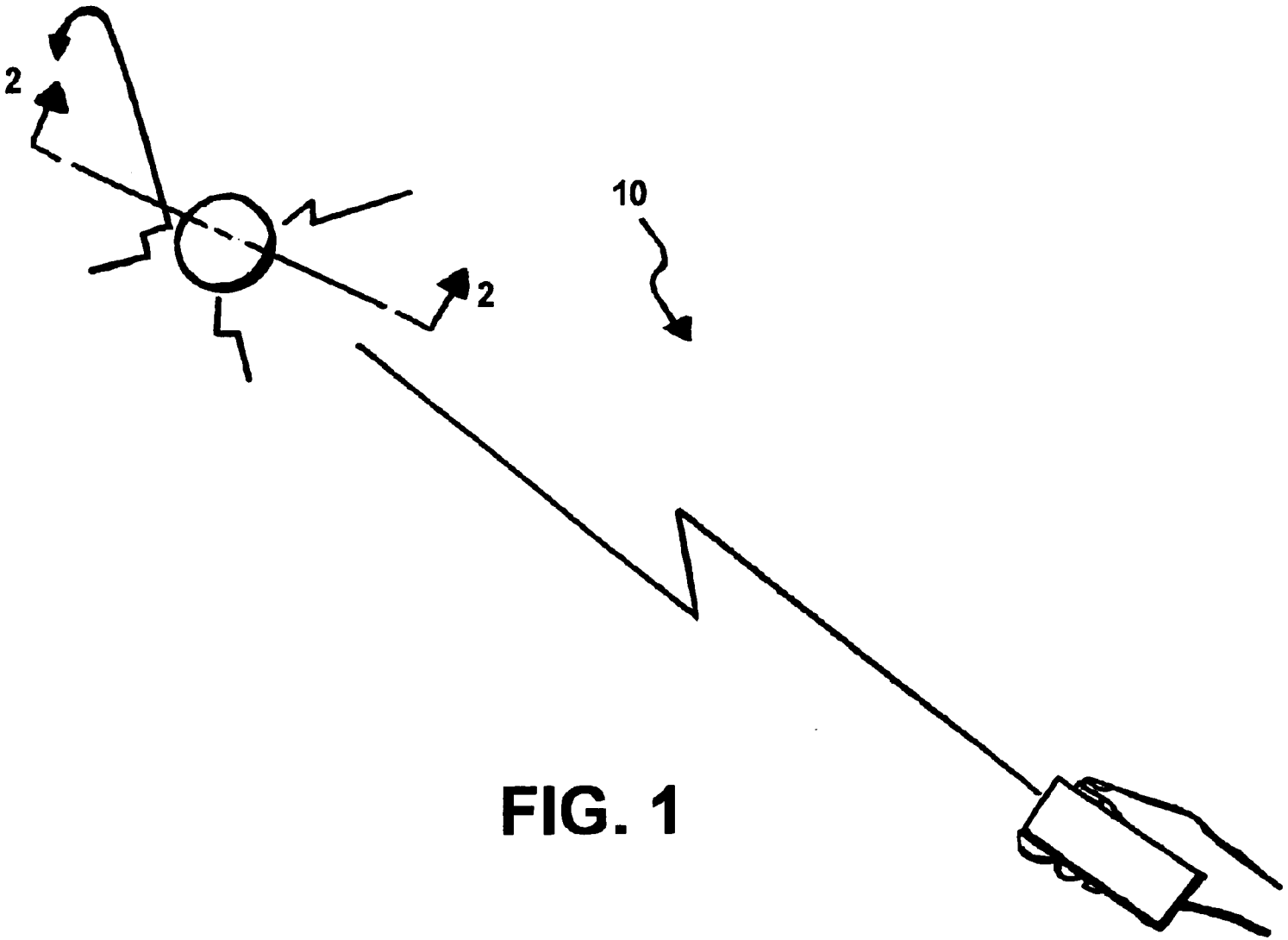
FIG. 1 is a diagrammatic perspective view of the present invention in use.

10 sealed golf ball with remotely activated audible sound generator powered by an electromagnetically rechargeable battery of the present invention
12 golf ball
14 outer wall of golf ball 12
16 cavity in golf ball 12
18 shock absorber defining cavity 16 in golf ball 12
20 small throughbores in shock absorber 18
22 coil-shaped miniature receiver antenna in cavity 16 of golf ball 12
24 first signal
26 miniature wireless receiver contained in cavity 16 of golf ball 12
28 second signal
30 audible acoustic generator contained in cavity 16 of golf ball 12
32 miniature oscillator of audible acoustic generator 30
34 miniature driver amplifier of audible acoustic generator 30
36 miniature transducer of audible acoustic generator 30
38 series of audible beeps
40 ambient
41 person
42 rechargeable micro-battery contained in cavity 16 of golf ball 12
44 transmitter housing for carrying by person 41 seeking to locate golf ball 12
46 wireless transmitter contained in transmitter housing 44
48 transmitter antenna disposed on transmitter housing 44
50 transmitter battery contained in transmitter housing 44
52 button switch disposed on transmitter housing 44
54 audible trail
56 battery charger housing selectively engageable with golf ball 12
58 battery charger contained in battery charger housing 56
60 recharging coil contained in battery charger housing 56
62 electromagnetic charge

DETAILED DESCRIPTION OF THE PREFERRED EMBODIMENT

Referring now to the figures, in which like numerals indicate like part, and particularly to FIG. 1, which is a diagrammatic perspective view of the present invention in use, the sealed golf ball with remotely activated audible sound generator powered by an electromagnetically rechargeable battery of the present invention is shown generally at 10.

The configuration of the sealed golf ball with remotely activated audible sound generator powered by an electromagnetically rechargeable battery 10 can best be seen in FIGS. 2, 3, and 4A–4T, which are, respectively, an enlarged cross sectional view taken on LINE 2—2 in FIG. 1 of the golf ball of the present invention, a diagrammatic perspective view of the micro-battery charger of the present invention, and a system diagram of the present invention.

Figure 2:
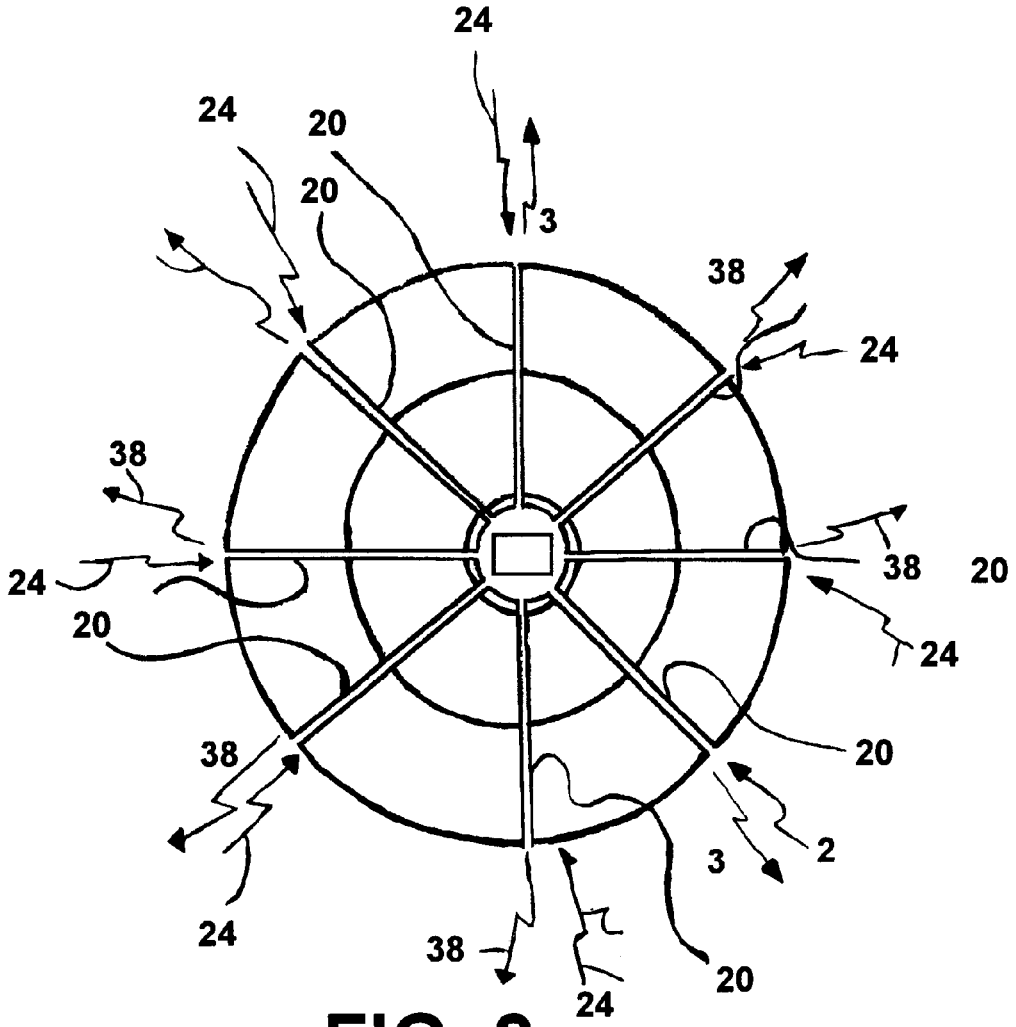
FIG. 2 is an enlarged cross sectional view taken on LINE 2—2 in FIG. 1 of the golf ball of the present invention.
Figure 4A:
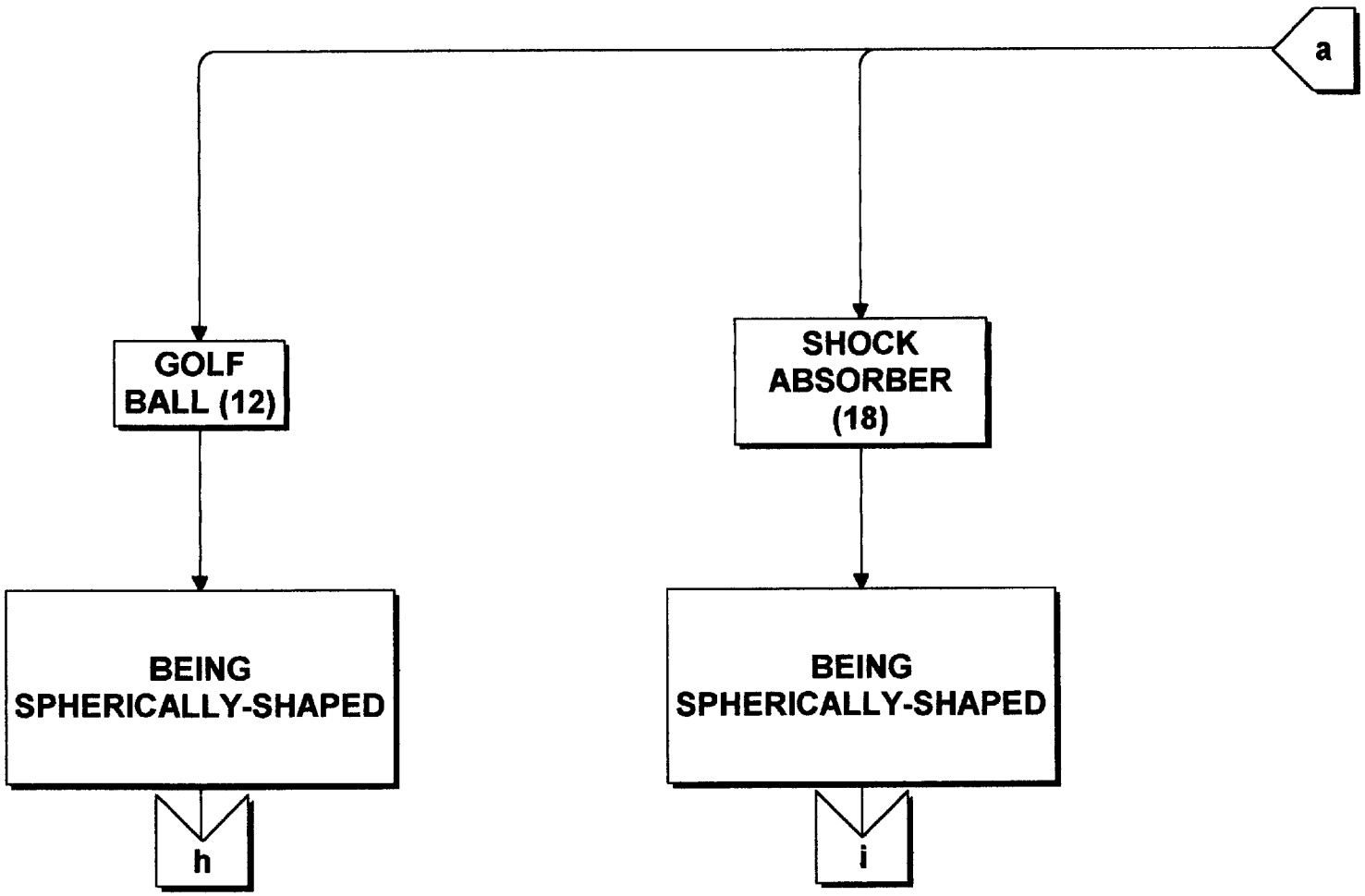
FIGS. 4A–4T are a system diagram of the present invention.
Figure 4B:
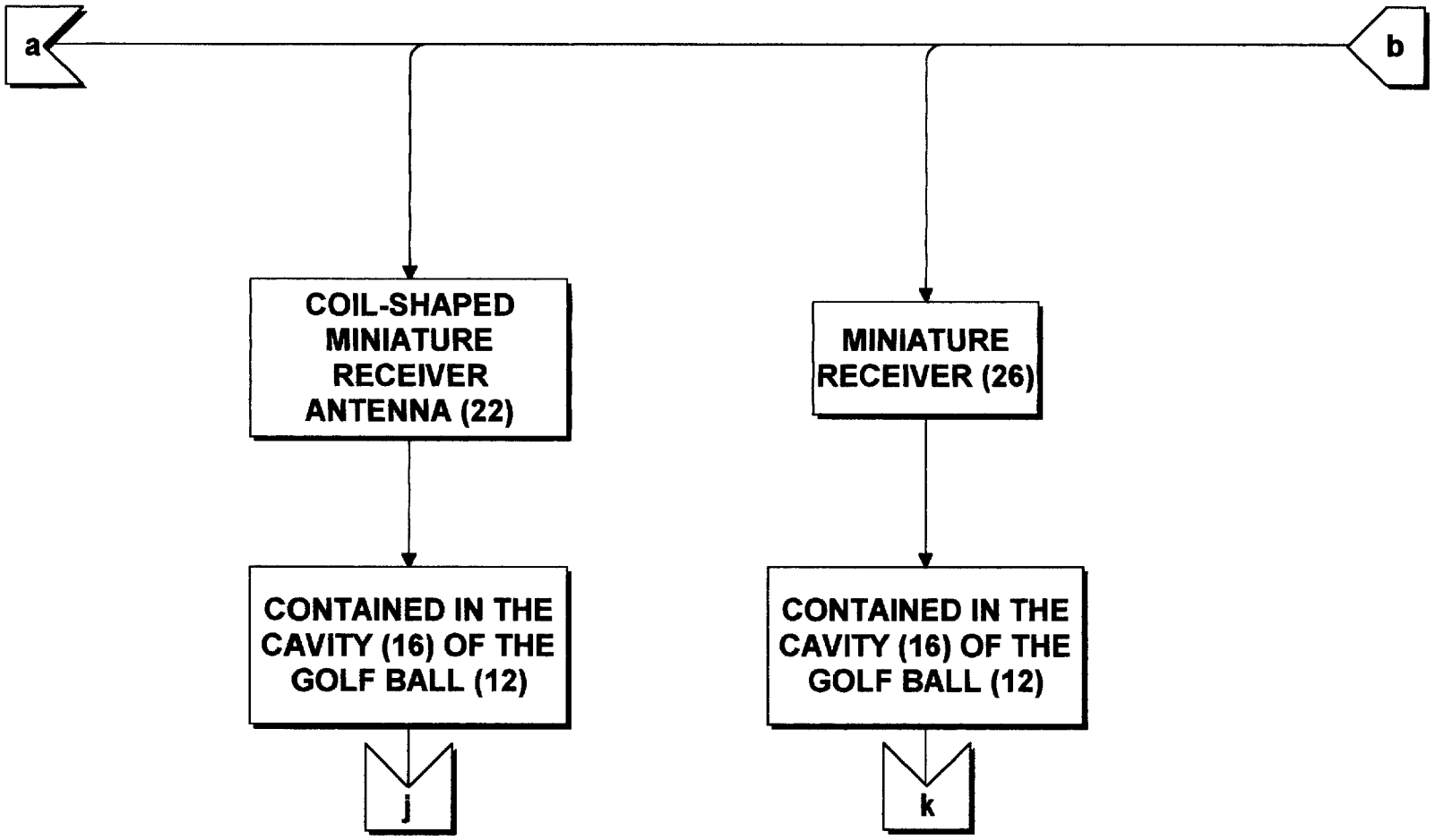
Figure 4C:
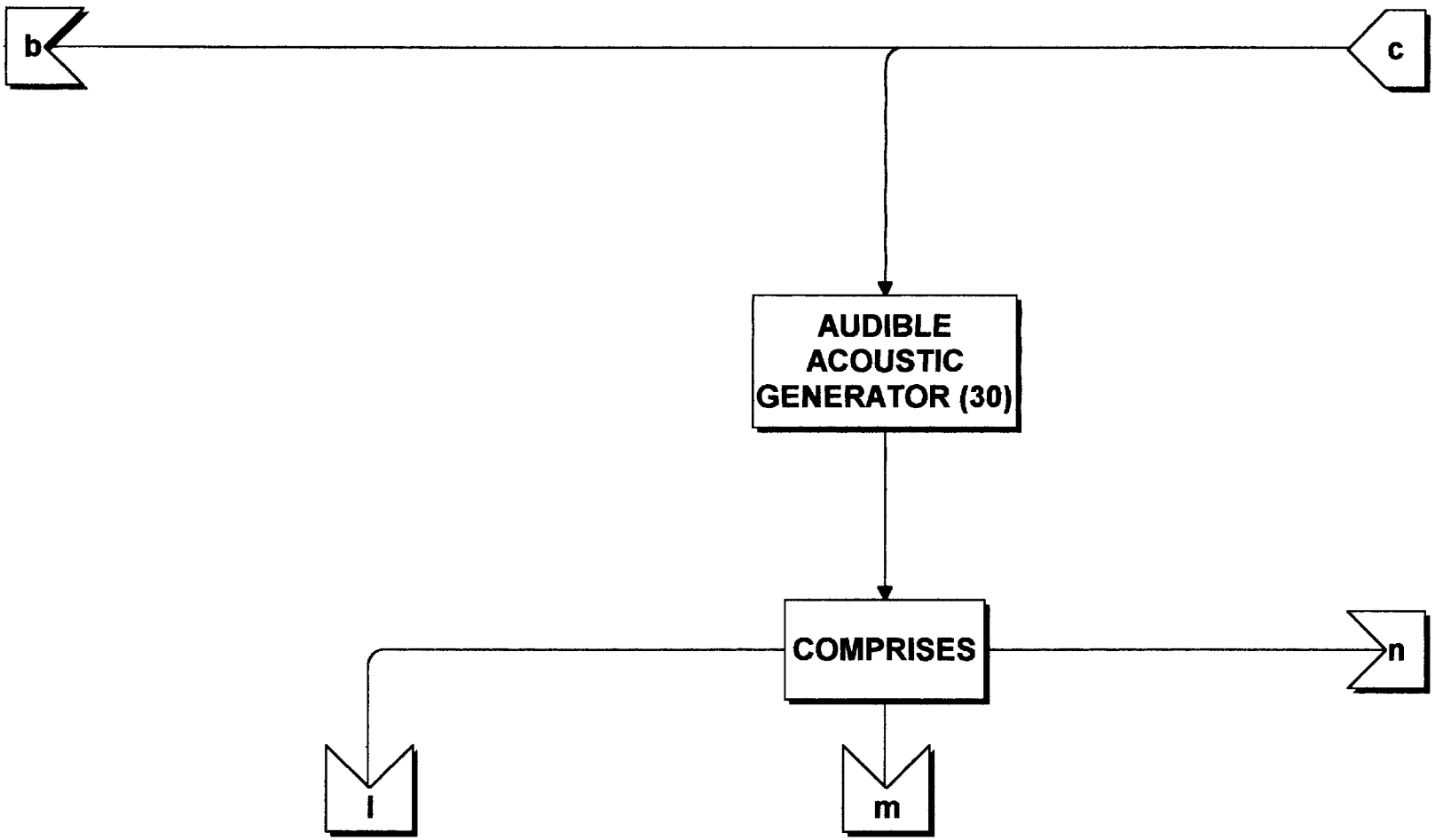
Figure 4D:
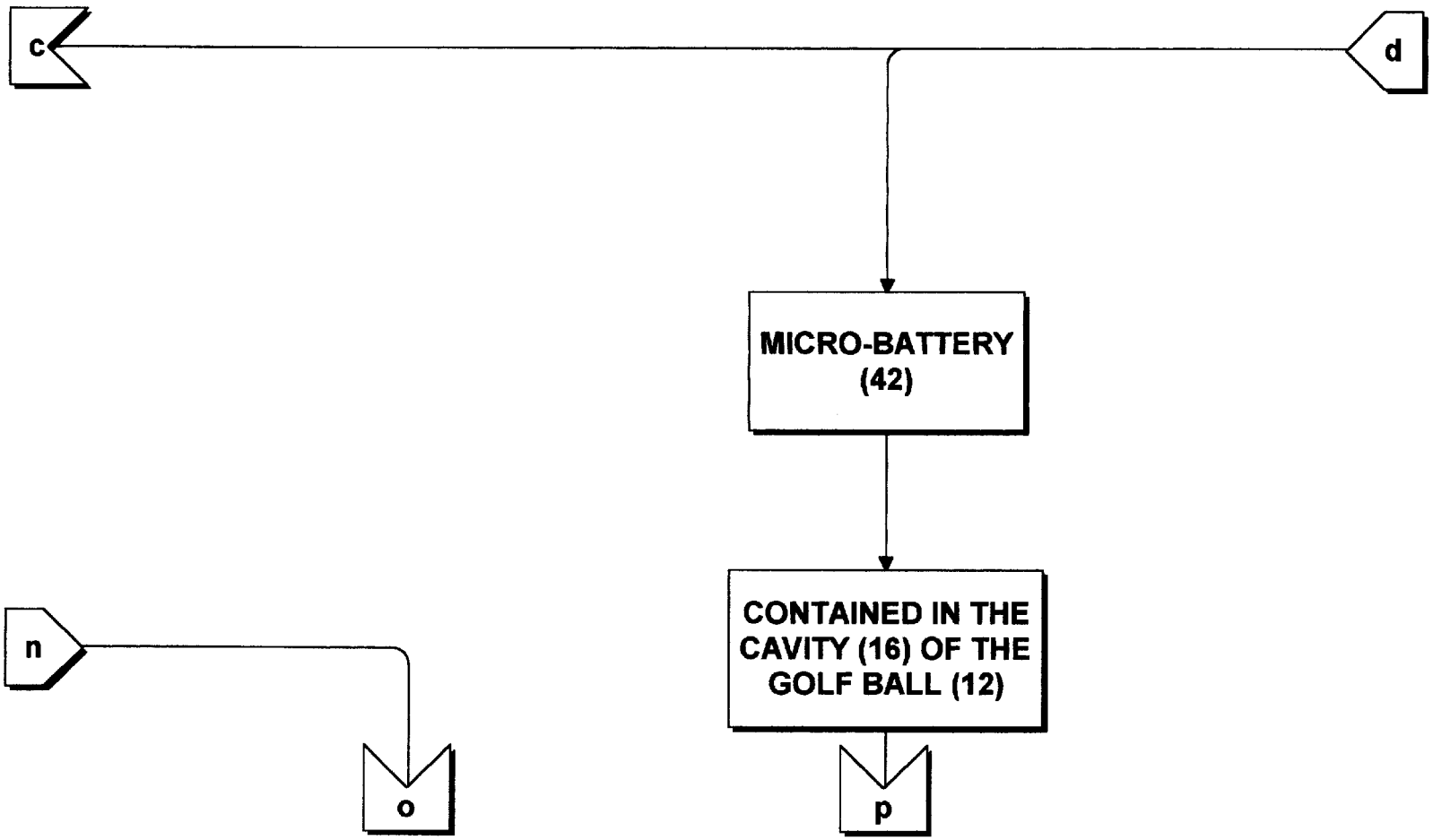
Figure 4E:
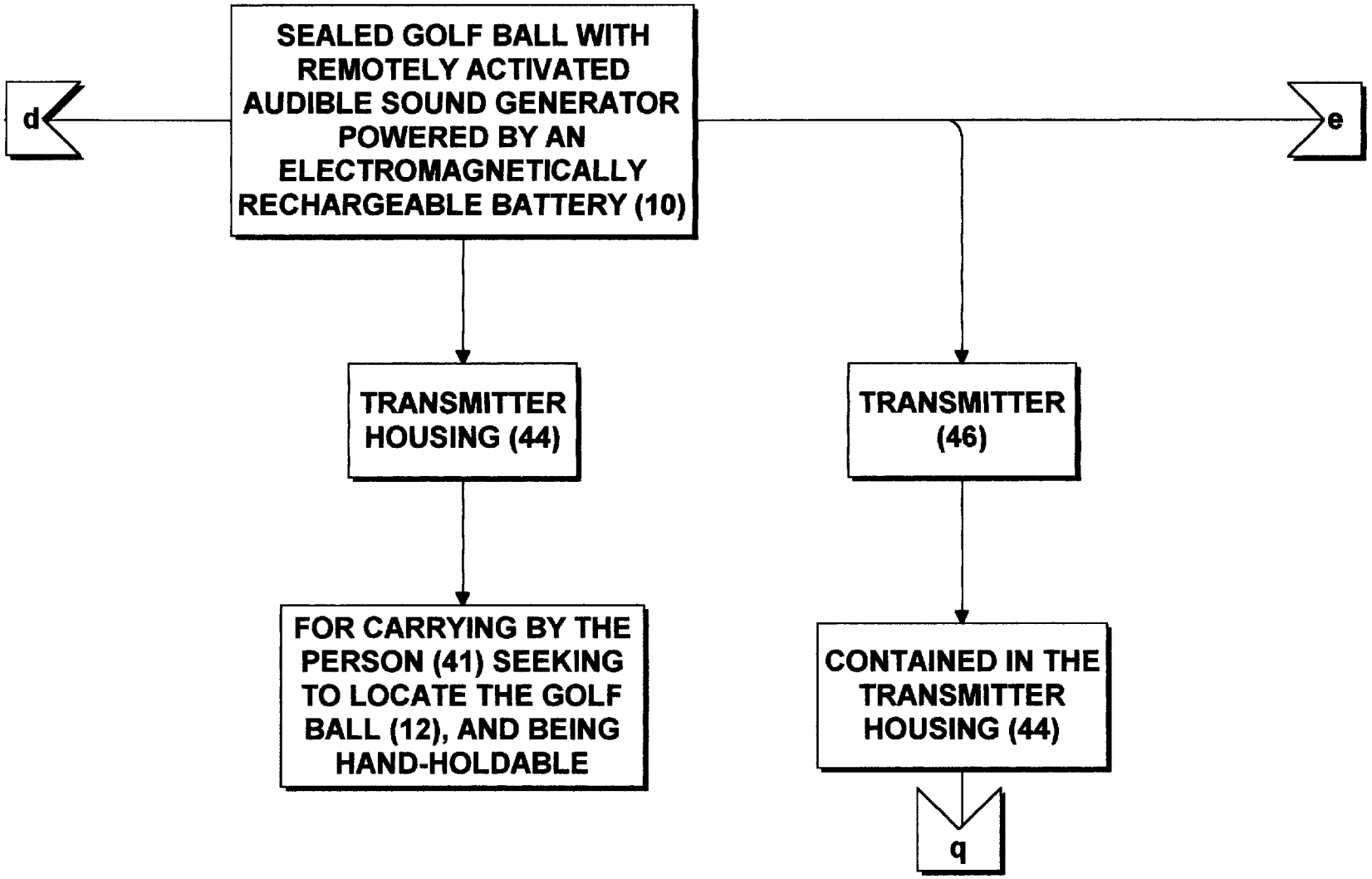
Figure 4F:
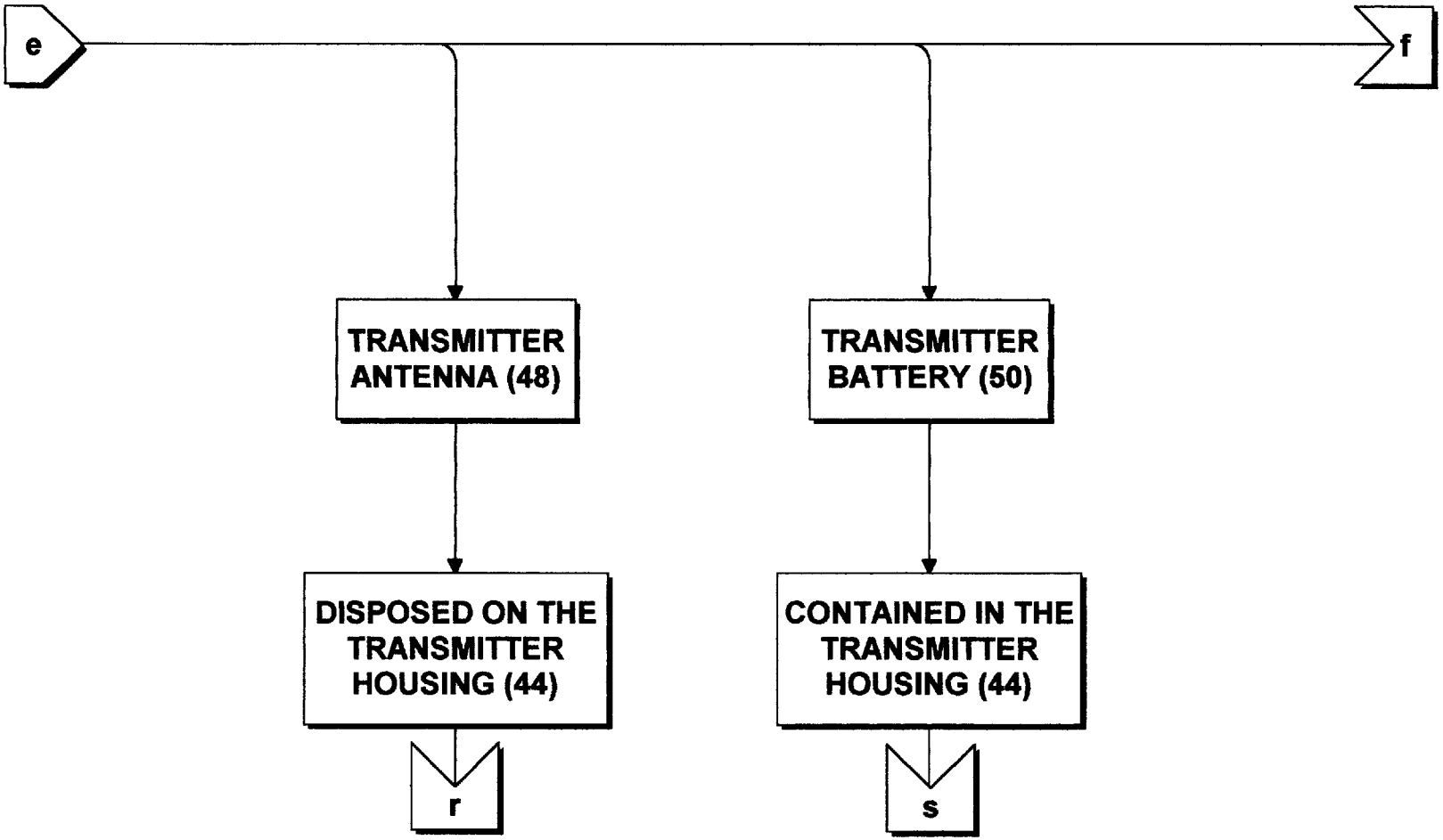
Figure 4G:
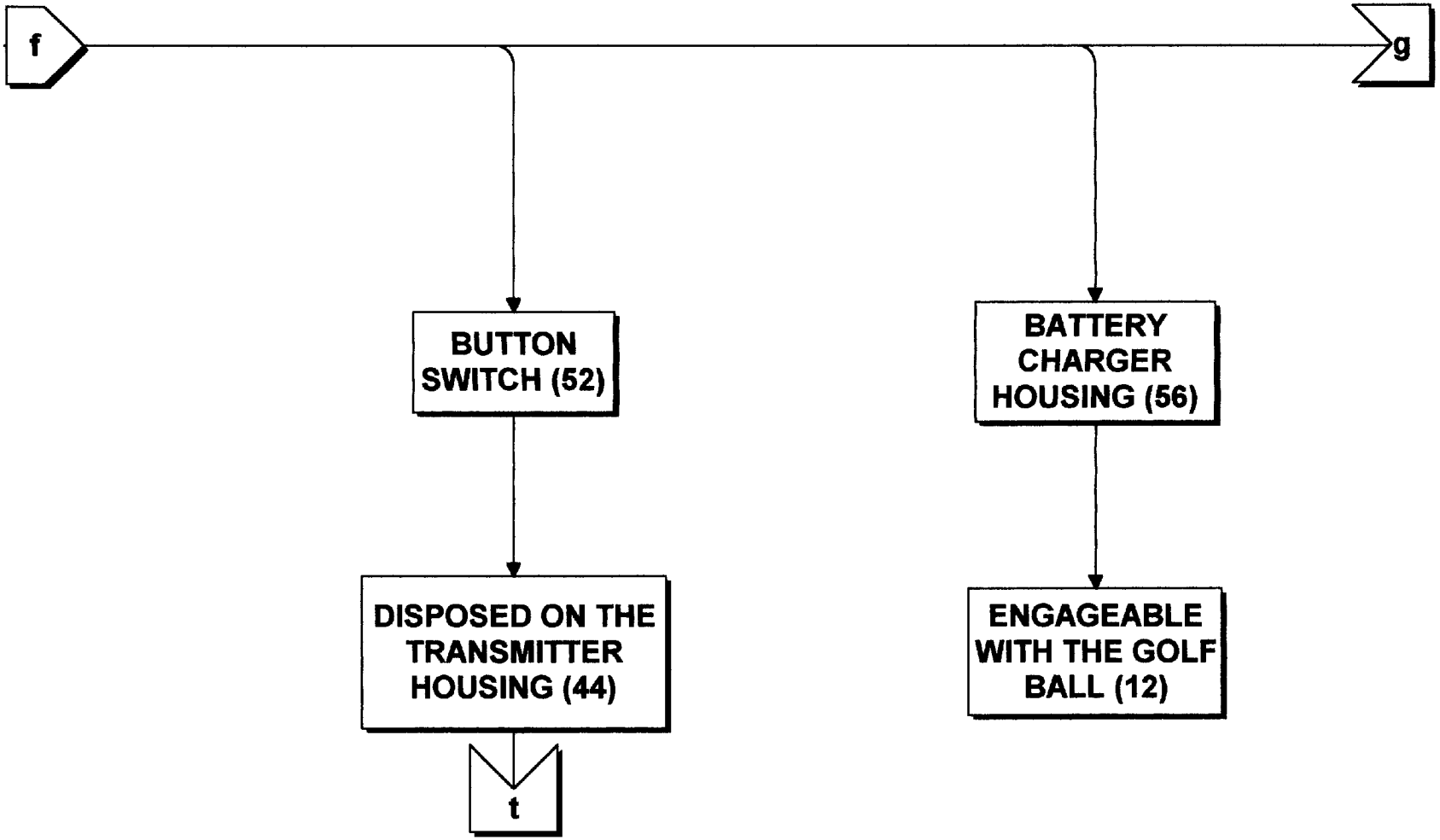
Figure 4H:
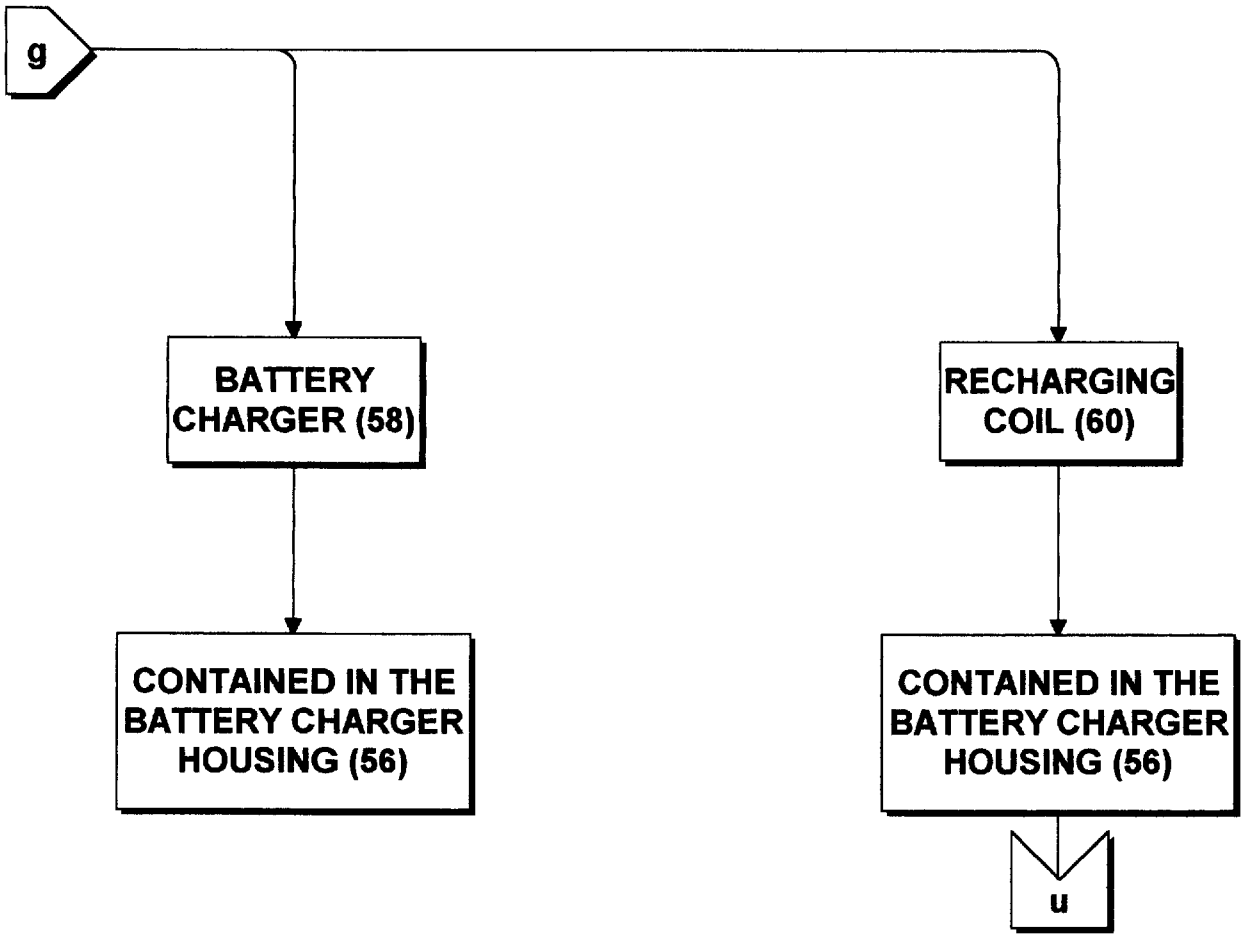
Figure 4I:
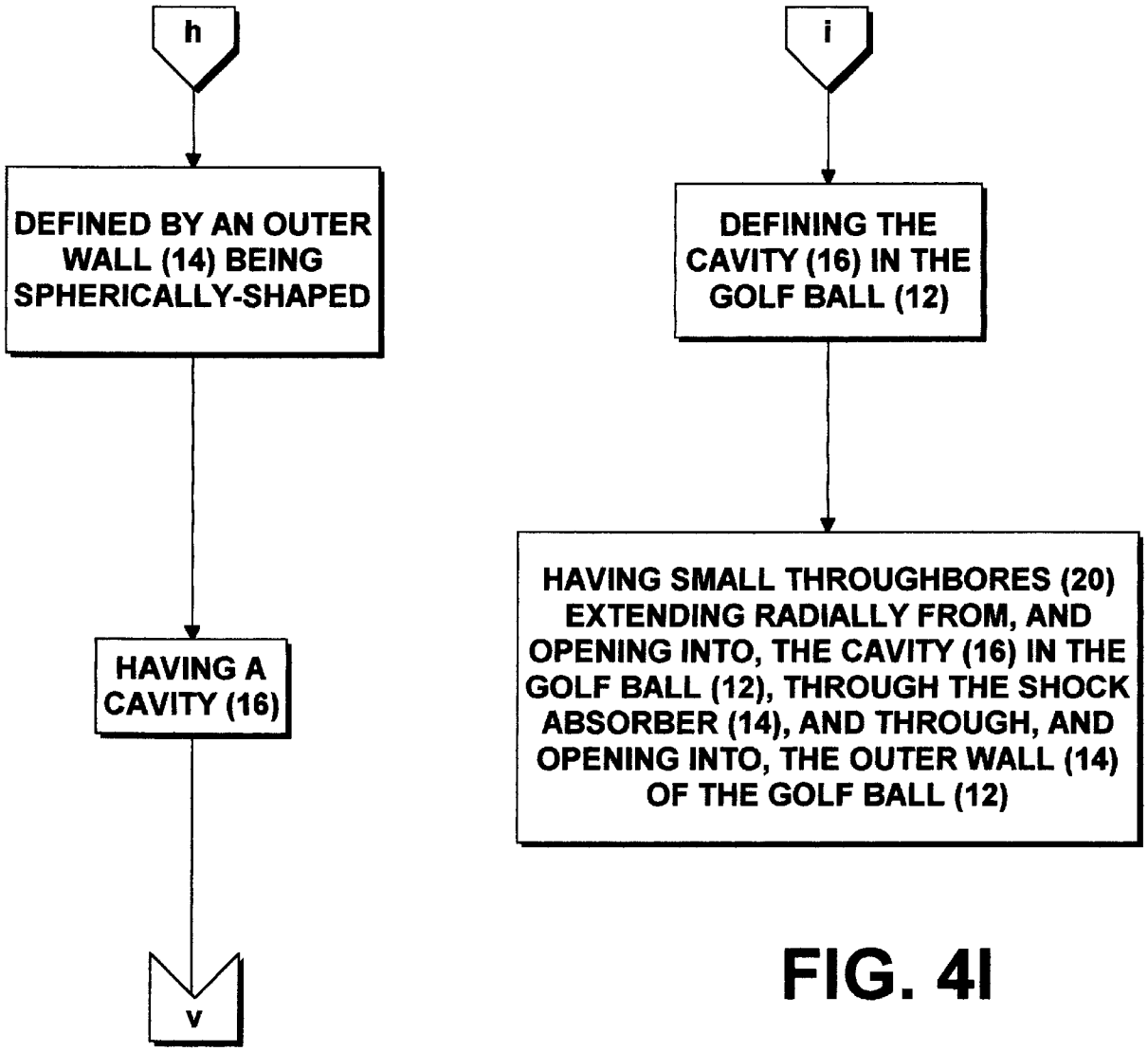
Figure 4J:
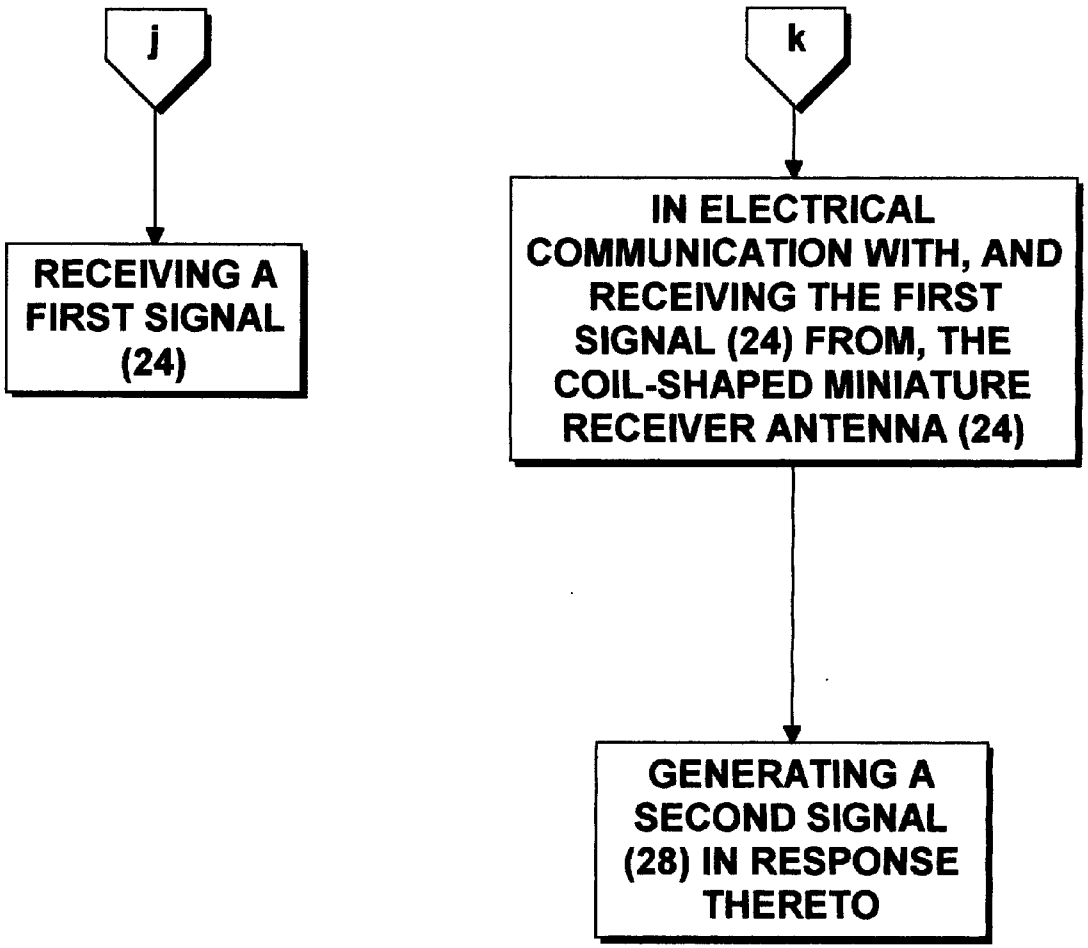
Figure 4K:
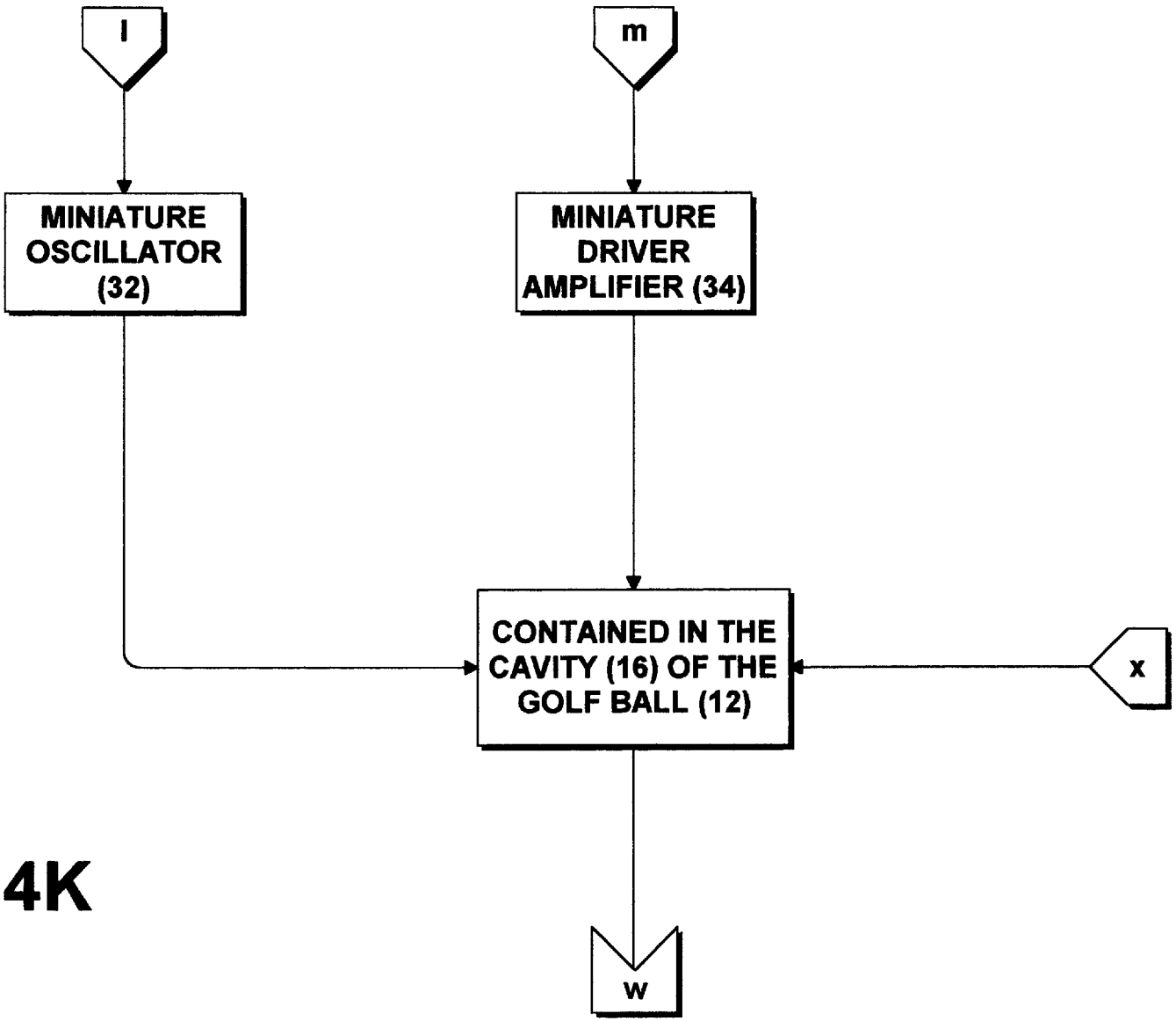
Figure 4L:
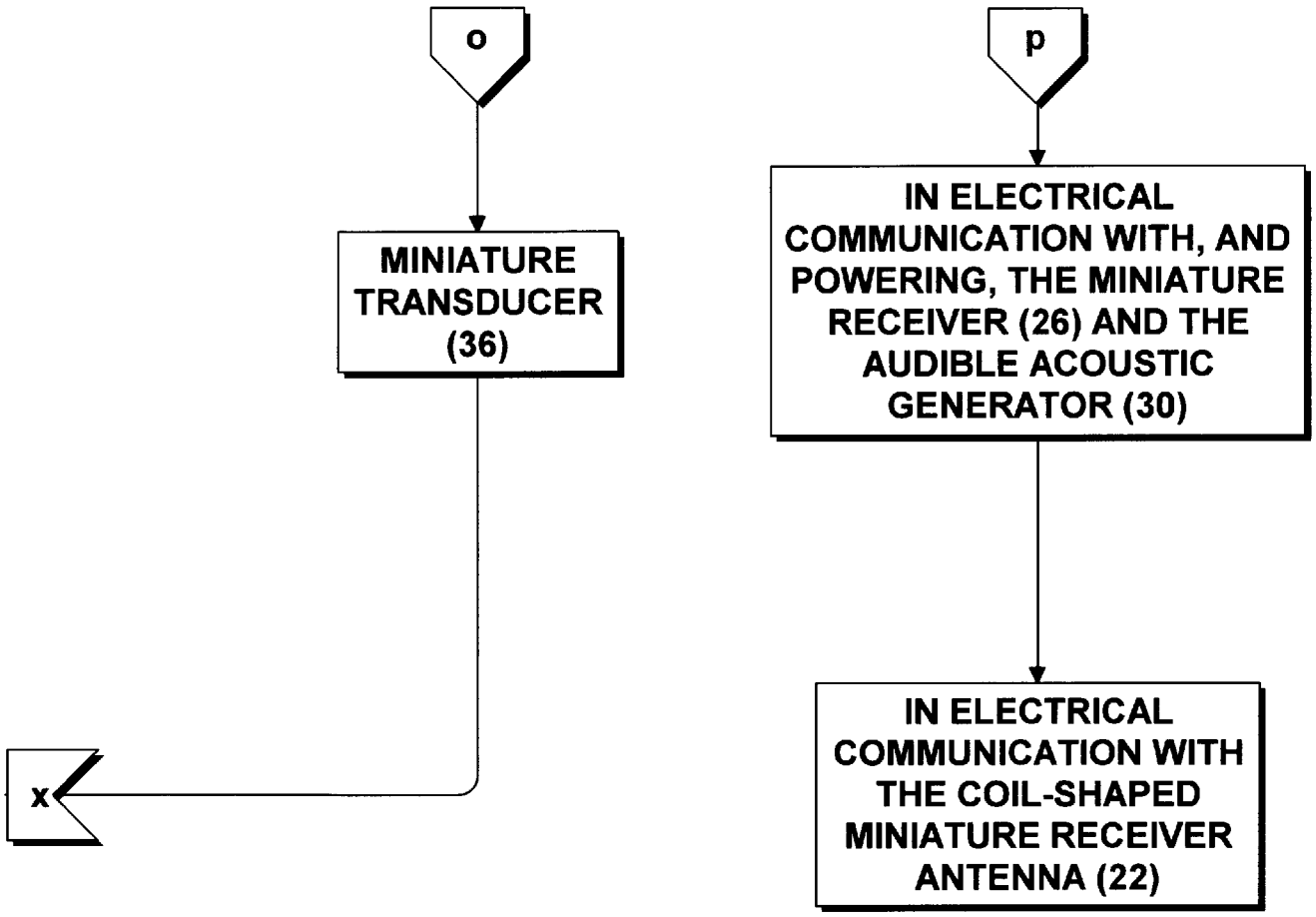
Figure 4M:
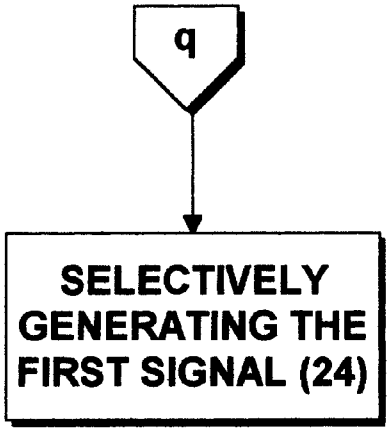
Figure 4N:
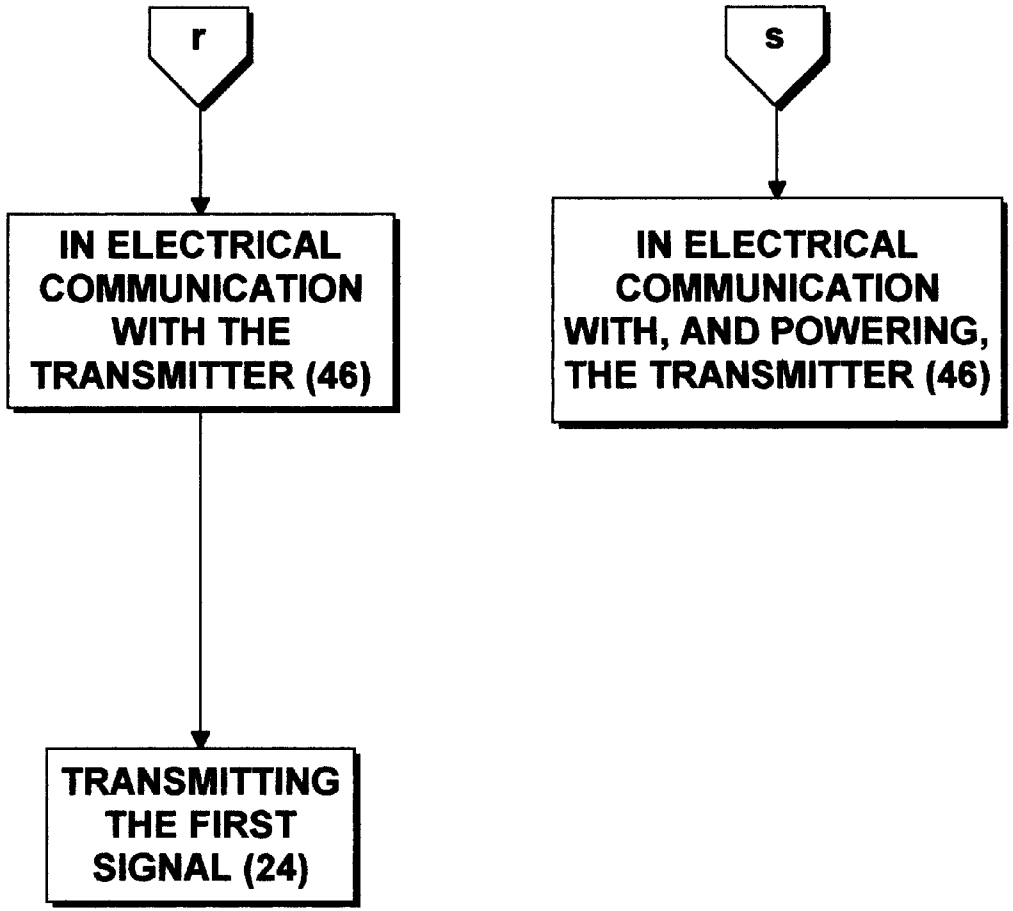
Figure 4O:
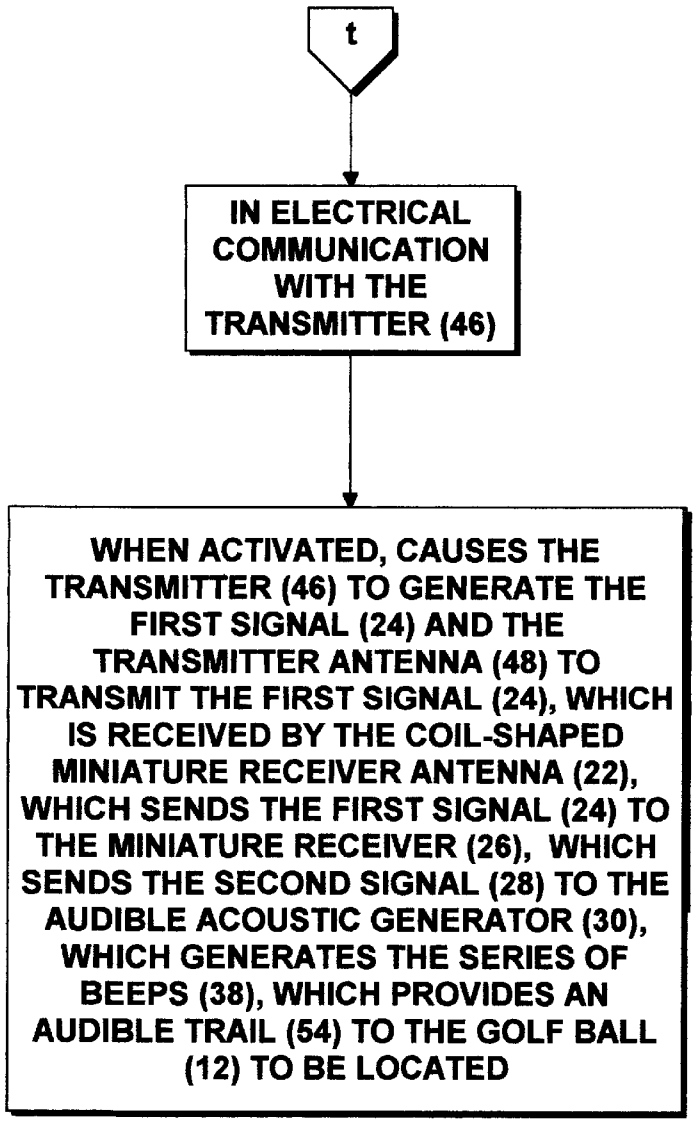
Figure 4P:
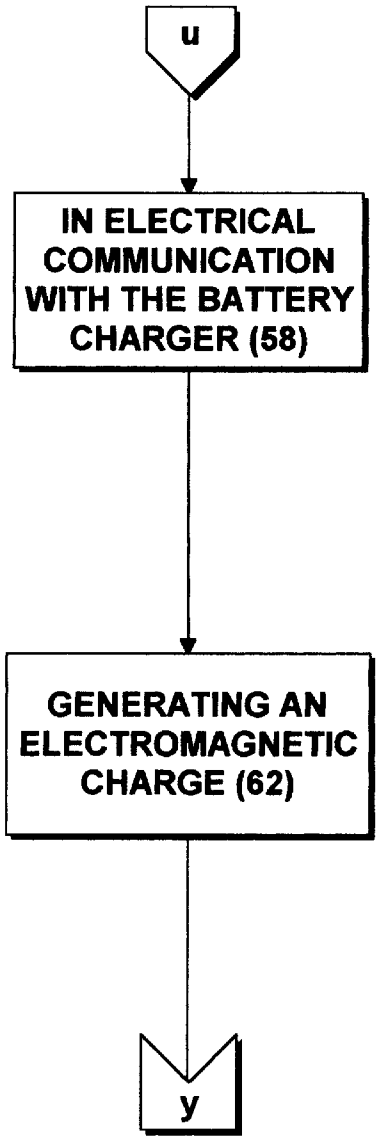
Figure 4Q:
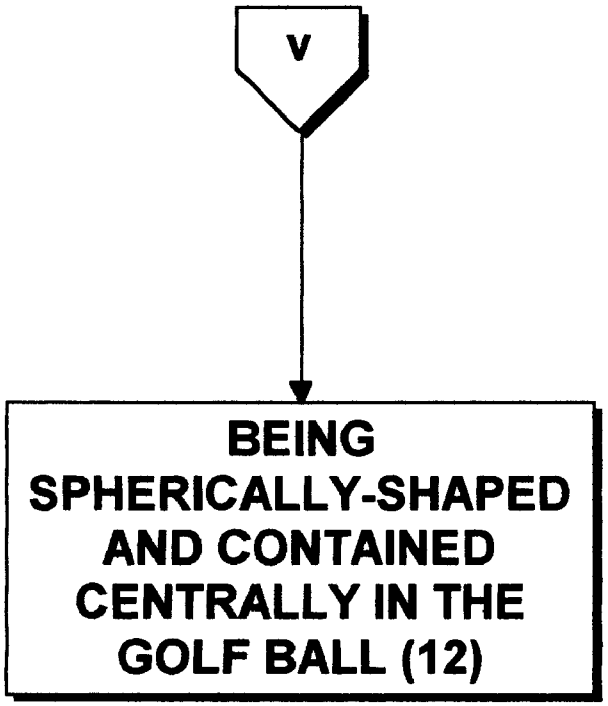
Figure 4R:
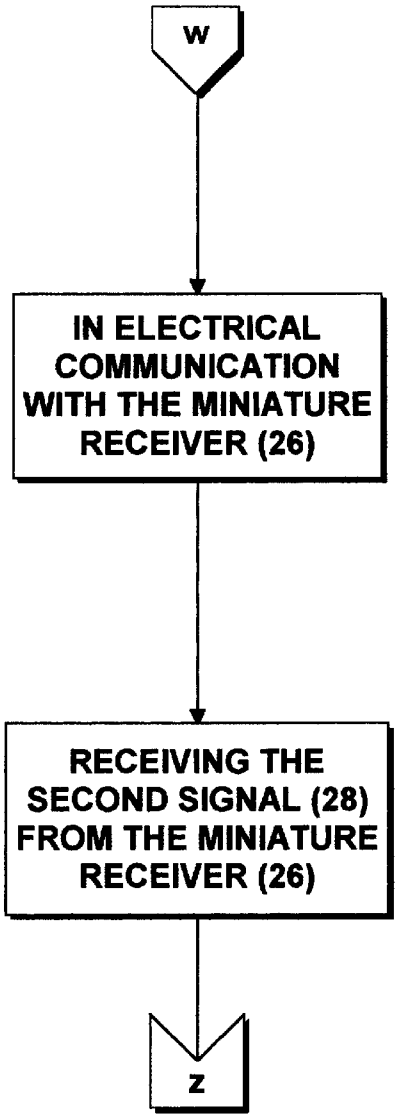
Figure 4S:
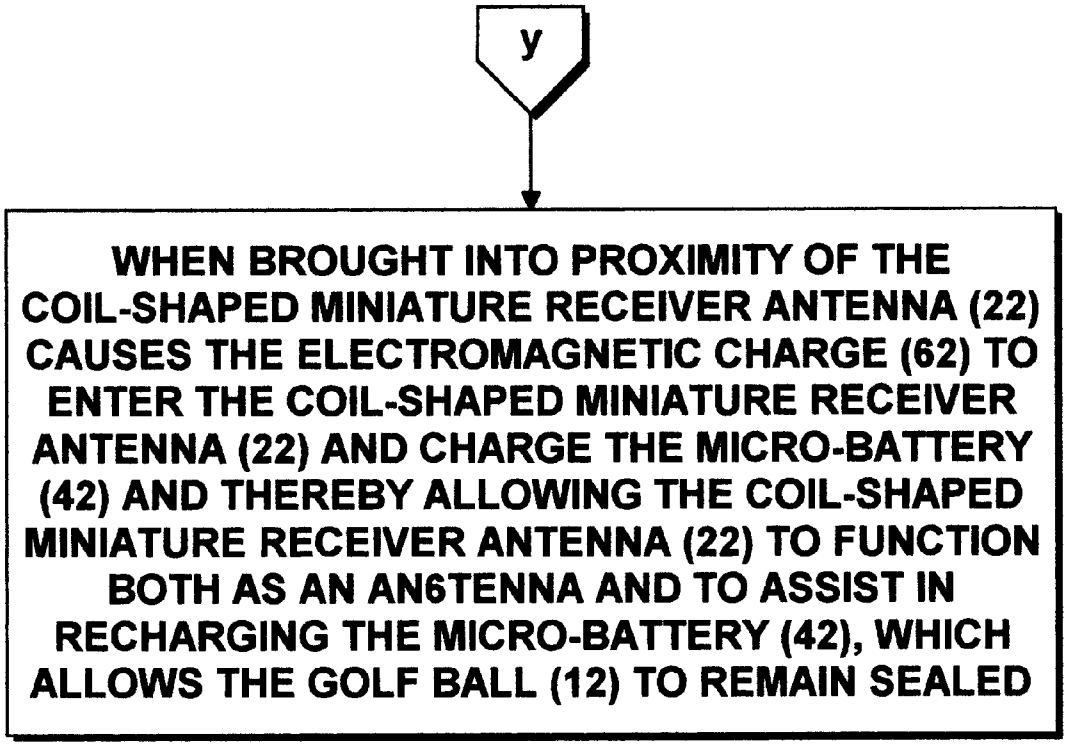
Figure 4T:
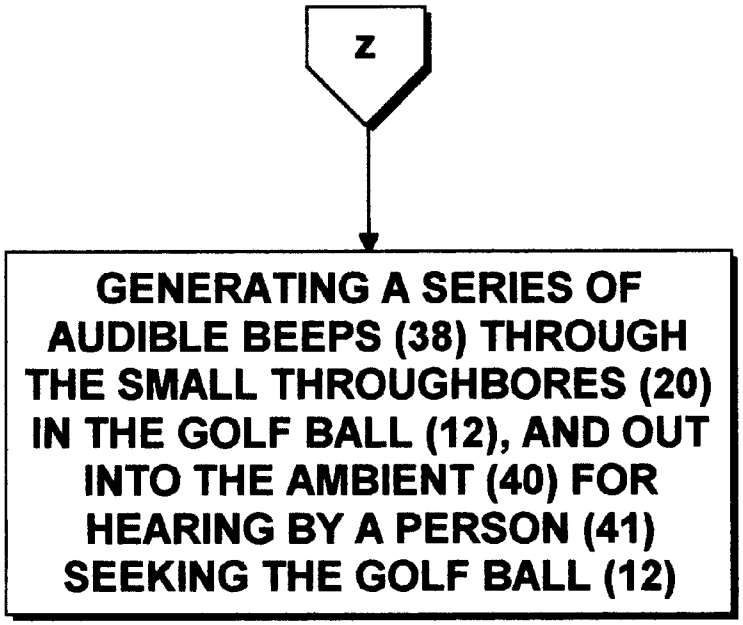

As shown in FIGS. 2 and 4A–4T, the sealed golf ball with remotely activated audible sound generator powered by an electromagnetically rechargeable battery 10 comprises a golf ball 12 that is spherically-shaped, and defined by an outer wall 14 that is spherically-shaped, and has a cavity 16 that is spherically-shaped and contained centrally in the golf ball 12.

As shown in FIGS. 2 and 4A–4T, the sealed golf ball with remotely activated audible sound generator powered by an electromagnetically rechargeable battery 10 further comprises a shock absorber 18 that is spherically-shaped, and defines the cavity 16 in the golf ball 12.

As shown in FIGS. 2 and 4A–4T, the shock absorber 18 has small throughbores 20 that extend radially from, and open into, the cavity 16 in the golf ball 12, through the shock absorber 14, and through, and open into, the outer wall 14 of the golf ball 12.

As shown in FIGS. 2 and 4A–4T, the sealed golf ball with remotely activated audible sound generator powered by an electromagnetically rechargeable battery 10 further comprises a coil-shaped miniature receiver antenna 22 that is contained in the cavity 16 in the golf ball 12, and receives a first signal 24.

As shown in FIGS. 2 and 4A–4T, the sealed golf ball with remotely activated audible sound generator powered by an electromagnetically rechargeable battery 10 further comprises a miniature wireless receiver 26 that is contained in the cavity 16 of the golf ball 12, is in electrical communication with, and receives the first signal 24 from, the coil-shaped miniature receiver antenna 22, and generates a second signal 28 in response thereto.

As shown in FIGS. 2 and 4A–4T, the sealed golf ball with remotely activated audible sound generator powered by an electromagnetically rechargeable battery 10 further comprises an audible acoustic generator 30 that is contained in the cavity 16 of the golf ball 12, is in electrical communication with the miniature wireless receiver 26, receives the second signal 28 from the miniature wireless receiver 26, and generates a series of audible beeps 38 through the small throughbores 20 in the golf ball 12, and out into the ambient 40 for hearing by a person 41 seeking the golf ball 12.

As shown in FIGS. 2 and 4A–4T, the audible acoustic generator 30 comprises a miniature oscillator 32, a miniature driver amplifier 34, and a miniature transducer 36.

As shown in FIGS. 2 and 4A–4T, the sealed golf ball with remotely activated audible sound generator powered by an electromagnetically rechargeable battery 10 further comprises a rechargeable micro-battery 42 that is contained in the cavity 16 of the golf ball 12, is in electrical communication with, and powers, the miniature wireless receiver 26 and the audible acoustic generator 30, and is in electrical communication with the coil-shaped miniature receiver antenna 22.

As shown in FIGS. 4A–4T, the sealed golf ball with remotely activated audible sound generator powered by an electromagnetically rechargeable battery 10 further comprises a transmitter housing 44 for carrying by the person 41 seeking to locate the golf ball 12, and is hand-holdable.

As shown in FIGS. 4A–4T, the sealed golf ball with remotely activated audible sound generator powered by an electromagnetically rechargeable battery 10 further comprises a wireless transmitter 46 that is contained in the transmitter housing 44, and selectively generates the first signal 24.

As shown in FIGS. 4A–4T, the sealed golf ball with remotely activated audible sound generator powered by an electromagnetically rechargeable battery 10 further comprises a transmitter antenna 48 that is disposed on the transmitter housing 44, is in electrical communication with the wireless transmitter 46, and transmits the first signal 24.

As shown in FIGS. 4A–4T, the sealed golf ball with remotely activated audible sound generator powered by an electromagnetically rechargeable battery 10 further comprises a transmitter battery 50 that is contained in the transmitter housing 44, and is in electrical communication with, and powers, the wireless transmitter 46.

As shown in FIGS. 4A–4T, the sealed golf ball with remotely activated audible sound generator powered by an electromagnetically rechargeable battery 10 further comprises a button switch 52 that is disposed on the transmitter housing 44, and is in electrical communication with the wireless transmitter 46, and when activated, causes the wireless transmitter 46 to generate the first signal 24 and the transmitter antenna 48 to transmit the first signal 24, which is received by the coil-shaped miniature receiver antenna 22, which sends the first signal 24 to the miniature wireless receiver 26, which sends the second signal 28 to the audible acoustic generator 30, which generates the series of audible beeps 38, which provides an audible trail 54 to the golf ball 12 to be located.

Figure 3:
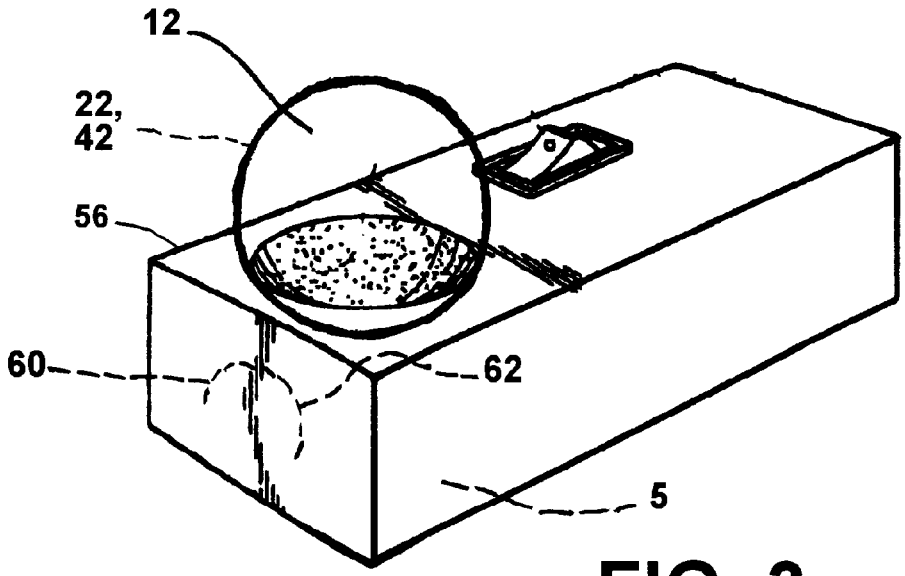
FIG. 3 is a perspective view of the micro-battery charger of the present invention.

As shown in FIG. 3, the sealed golf ball with remotely activated audible sound generator powered by an electromagnetically rechargeable battery 10 further comprises a battery charger housing 56 that is selectively engageable with the golf ball 12.

As shown in FIG. 3, the sealed golf ball with remotely activated audible sound generator powered by an electromagnetically rechargeable battery 10 further comprises a battery charger 58 that is contained in the battery charger housing 56.

As shown in FIG. 3, the sealed golf ball with remotely activated audible sound generator powered by an electromagnetically rechargeable battery 10 further comprises a recharging coil 60 that is contained in the battery charger housing 56, is in electrical communication with the battery charger 58, and generates an electromagnetic charge 62, and when brought into proximity of the coil-shaped miniature receiver antenna 22, causes the electromagnetic charge 62 to enter the coil-shaped miniature receiver antenna 22 and charge the rechargeable micro-battery 42 and thereby allow the coil-shaped miniature receiver antenna 22 to function both as an antenna and to assist in recharging the rechargeable micro-battery 42, which allows the golf ball 12 to remain sealed and never opened for internal contamination.

It will be understood that each of the elements described above, or two or more together, may also find a useful application in other types of constructions differing from the types described above.

While the invention has been illustrated and described as embodied in a sealed golf ball with remotely activated audible sound generator powered by an electromagnetically rechargeable battery, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A sealed golf ball with remotely activated audible sound generator powered by an electromagnetically rechargeable battery, said sealed golf ball comprising:

a) a golf ball;

b) a shock absorber contained in said golf ball;

c) a coil-shaped miniature receiver antenna contained in said golf ball, and receiving a first signal;

d) a miniature wireless receiver contained in said golf ball, being in electrical communication with, and receiving said first signal from, said coil-shaped miniature receiver antenna, and generating a second signal in response thereto;

e) an audible acoustic generator contained in said golf ball, being in electrical communication with said miniature wireless receiver, receiving said second signal from said miniature wireless receiver, and generating a series of audible beeps through said golf ball, and out into the ambient for hearing by a person seeking said golf ball;

f) a rechargeable micro-battery contained in said golf ball, and being in electrical communication with, and powering, said miniature wireless receiver and said audible acoustic generator;

g) a transmitter housing for carrying by said person seeking to locate said golf ball;

h) a wireless transmitter contained in said transmitter housing, and selectively generating said first signal;

i) a transmitter antenna disposed on said transmitter housing, being in electrical communication with said wireless transmitter, and transmitting said first signal; and j) a switch disposed on said transmitter housing, and being in electrical communication with said wireless transmitter, and when activated, causing said wireless transmitter to generate said first signal and said transmitter antenna to transmit said first signal, which is received by said coil-shaped miniature receiver antenna, which sends said first signal to said miniature wireless receiver, which sends said second signal to said audible acoustic generator, which generates said series of audible beeps, which provides an audible trail to said golf ball to be located.

2. The sealed golf ball as defined in claim 1, wherein said golf ball is spherically-shaped.

3. The sealed golf ball as defined in claim 1, wherein said golf ball is defined by an outer wall.

4. The sealed golf ball as defined in claim 3, wherein said outer wall of said golf ball is spherically-shaped.

5. The sealed golf ball as defined in claim 3, wherein said golf ball has a cavity that is contained centrally in said golf ball.

6. The sealed golf ball as defined in claim 5, wherein said cavity in said golf ball is spherically-shaped.

7. The sealed golf ball as defined in claim 5, wherein said shock absorber defines said cavity in said golf ball.

8. The sealed golf ball as defined in claim 1, wherein said shock absorber is spherically-shaped.

9. The sealed golf ball as defined in claim 5, wherein said shock absorber has small throughbores that extend radially from, and open into, said cavity in said golf ball, through said shock absorber, and through, and open into, said outer wall of said golf ball.

10. The sealed golf ball as defined in claim 5, wherein said coil-shaped miniature receiver antenna is contained in said cavity of said golf ball.

11. The sealed golf ball as defined in claim 5, wherein said miniature wireless receiver is contained in said cavity of said golf ball.

12. The sealed golf ball as defined in claim 5, wherein said audible acoustic generator is contained in said cavity of said golf ball.

13. The sealed golf ball as defined in claim 1, wherein said audible acoustic generator generates said series of audible beeps through said small throughbores in said golf ball.

14. The sealed golf ball as defined in claim 1, wherein said audible acoustic generator comprises:

a) a miniature oscillator;

b) a miniature driver amplifier; and c) a miniature transducer.

15. The sealed golf ball as defined in claim 5, wherein said rechargeable micro-battery is contained in said cavity of said golf ball.

16. The sealed golf ball as defined in claim 1, wherein said rechargeable micro-battery is in electrical communication with said coil-shaped miniature receiver antenna.

17. The sealed golf ball as defined in claim 1, wherein said transmitter housing is hand-holdable.

18. The sealed golf ball as defined in claim 1, further comprising a transmitter battery contained in said transmitter housing, and being in electrical communication with, and powering, said wireless transmitter.

19. The sealed golf ball as defined in claim 1, wherein said switch is a button switch.

20. The sealed golf ball as defined in claim 1, further comprising a battery charger housing being selectively engageable with said golf ball.

21. The sealed golf ball as defined in claim 20, further comprising a battery charger contained in said battery charger housing.

22. The sealed golf ball as defined in claim 21, further comprising a recharging coil contained in said battery charger housing, being in electrical communication with said battery charger, and generating an electromagnetic charge, and when brought into proximity of said coil-shaped miniature receiver antenna, causes said electromagnetic charge to enter said coil-shaped miniature receiver antenna and charge said rechargeable micro-battery, and thereby allow said coil-shaped miniature receiver antenna to function both as an antenna and to assist in recharging said rechargeable micro-battery, which allows said golf ball to remain sealed and never opened for internal contamination.

* * * * *